United States Patent [19]

Kilbarger

[11] Patent Number: 4,848,456

[45] Date of Patent: Jul. 18, 1989

[54] CONTINUOUS BRINE LEAKAGE MONITORING SYSTEM FOR A PRODUCTION OIL WELL

[76] Inventor: James E. Kilbarger, P.O. Box 946, Logan, Ohio 43138

[21] Appl. No.: 220,852

[22] Filed: Jul. 18, 1988

[51] Int. Cl.[4] ..... G01M 3/26

[52] U.S. Cl. ..... 166/113; 73/40; 73/40.5 R; 405/54

[58] Field of Search ..... 166/250, 305.1, 313, 166/369, 113, 115, 337, 242, 116; 405/54, 59; 73/40, 40.5 R, 49.3

[56] References Cited

U.S. PATENT DOCUMENTS

| | | | |
|---|---|---|---|
| 2,187,275 | 1/1940 | McLennan | 166/113 |
| 3,339,415 | 9/1967 | Wild | 73/40.5 R |
| 4,474,053 | 10/1984 | Butler | 405/54 X |

*Primary Examiner*—William P. Neuder

*Attorney, Agent, or Firm*—John L. Gray

[57] ABSTRACT

A brine leakage monitoring system for a production oil well where brine is returned to a brine bearing strata in the ground through casing surrounding the production casing of said oil well, including means for continuously monitoring the pressure in the area surrounding the brine disposal casing to detect any leaks that might occur so that brine does not seep into any strata, other than the brine bearing strata.

9 Claims, 1 Drawing Sheet

CONTINUOUS BRINE LEAKAGE MONITORING SYSTEM FOR A PRODUCTION OIL WELL

BACKGROUND OF THE INVENTION

Certain types of oil wells produce a mixture of oil, gas, and brine. The brine is separated from the oil and gas and recovered, usually in tanks, but its disposal is a major problem.

One technique of disposal is to drill additional wells (called injection wells) where the brine is pumped down into a brine bearing strata in the ground. This is prohibitively expensive for many wells and subjects the environment to further hazard during handling and transportation.

An additional manner in which brine is disposed of is to pump it back into the brine bearing strata in a casing which surrounds the oil and gas production casing of the well from which it was extracted. The disadvantage of doing this is that in order to meet federal and state EPA standards, from time to time it is necessary to pull the entire drill string and surrounding casing and subject the system to testing to make sure that there are no leaks.

There is no current system for continuous monitoring for leaks of brine in which the brine is injected into the brine bearing strata in the ground through a casing surrounding the production casing. Some states are considering banning the practice altogether or, as an alternative, conducting five year mechanical integrity tests on the production and brine disposal casings. These tests are expensive because they involve pulling the entire string and subjecting the system to such testing. As a result, the economics are such that older wells will be plugged rather than tested.

BRIEF DESCRIPTION OF THE INVENTION

The present invention comprises a continuous brine leakage monitoring system for a production oil well where the brine is returned to a brine bearing strata in the ground through a casing which surrounds the oil production casing contemporaneously with oil removal from an oil bearing strata. A further casing surrounding this assembly is employed which is sealed at its top and its bottom to the casing which surrounds the production casing. By pressurizing this casing it is possible to detect by a drop in pressure any leakage into the soil of brine by failure of the casing conducting the brine down to the brine bearing strata. This invention can be used on older wells at little cost, since the materials used are recoverable and, of course, would be easy to install in new wells.

It is therefore an object of this invention to provide a continuous brine leakage monitoring system for a production oil well where the brine is returned to a brine bearing strata in the ground in a casing surrounding the oil production casing.

It is a further object of this invention to provide such a system which may be readily installed on existing wells.

It is a still further object of this invention to provide such a system which may be installed on new wells during the initial drilling phase.

These, together with other objects and advantages of the invention will become more readily apparent to those skilled in the art when the following general statements and descriptions are read in the light of the appended drawings.

DETAILED DESCRIPTION OF THE INVENTION

Figure 1:
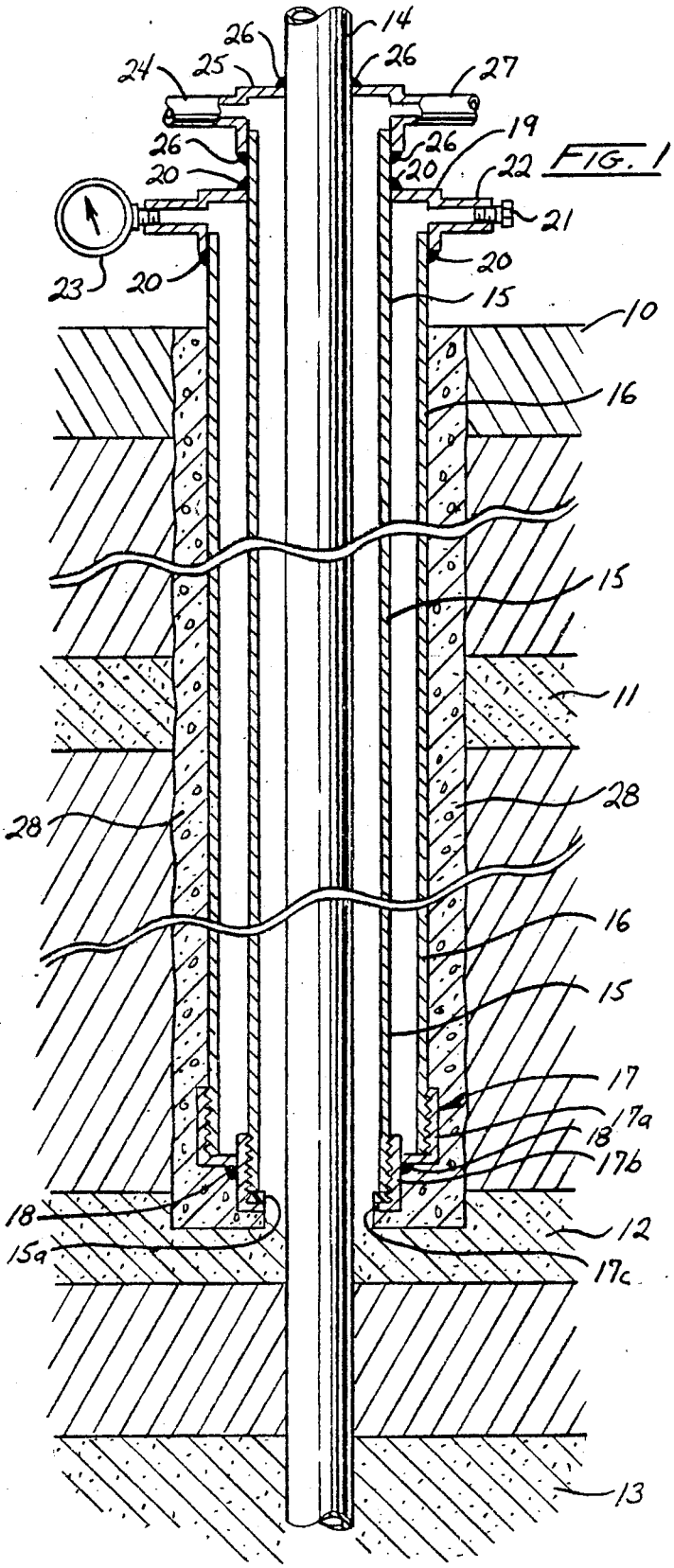
FIG. 1 is a side elevation view, partly in section, showing applicant's invention as applied to a typical oil production well.
Figure 2:
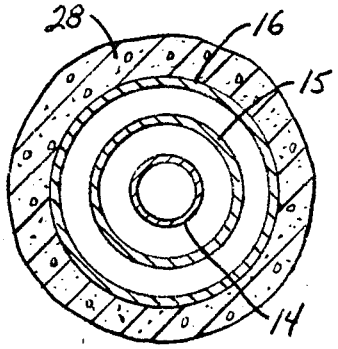
FIG. 2 is a section through applicant's invention.

Referring more particularly to FIG. 1, the ground surface is indicated at 10, a fresh water bearing strata is indicated at 11, a brine bearing strata is indicated at 12, and the oil production strata is indicated at 13. The oil producting casing is shown at 14 and the casing 15 surrounds the oil production casing 14 and extends down to the brine bearing strata 12. Surrounding the casing 15 is a third casing 16 which threadedly engages the outer portion of collar 17 at the base thereof at 17*a*, which collar 17 is threadedly attached to casing 15 at the inner collar portion thereof 17*b*. The inner portion 17*b* and the outer portion 17*a* of collar 17 are held together by means of weldments 18—18. Inner collar 17*b* is provided with a lower inwardly extending lip 17*c* adapted to receive a resilient circular seal 15*a*.

Likewise, the upper end of casing 16 and the upper end of casing 15 may be attached to collar 19 by means of weldments 20—20. A valve stop 21 is provided in valve 22 to permit the injection into the hollow zone thus created between casings 15 and 16 of a fluid, usually air, under pressure. Pressure valve 23 is provided, which may be of the recording type. Salt water is introduced into the space between casing 15 and producting casing 14 by means of conduit 24 in collar 25, which may be secured by weldments 26—26 to casing 15 and to casing 14. A vent 27 is also provided in collar 25. Preferably casing 16 is enclosed in cement 28 from its bottom end in the brine bearing strata 12 to the ground surface 10.

In operation, the production well 14 has oil and gas and brine pumped therefrom, the oil and gas are separated from the brine and the brine is reintroduced into the system through conduit 24 in the annulus between casing 15 and production casing 14 down into the brine bearing strata 12. If a leak should occur in casing 15, a drop in pressure in the sealed annulus space between casing 15 and casing 16 will result. Thus a continuous brine leakage monitoring system is set forth which enables existing older wells to remain in production and which can be operated at a minimum cost to satisfy both federal and state regulations with respect to ensuring that brine reinjected into the soil does not contaminate fresh water systems.

While this invention has been described in its preferred embodiment, it is to be appreciated that variations therefrom may be made without departing from the true scope and spirit of the invention.

What is claimed:

1. A continuous brine leakage monitoring system for a production oil well wherein brine is returned to a brine bearing strata in the ground contemporaneously with oil removal from an oil bearing strata in the ground located below said brine bearing strata, comprising a first oil production casing extending from the surface of the ground to said oil bearing strata, a second casing surrounding and spaced from said first casing, a third casing spaced from and surrounding said second casing, said second and third casings extending from said ground surface to said brine bearing strata above said oil bearing strata, said second and third casings being provided with means at the lower ends of said second and third casings adjacent said brine bearing strata sealing said ends of said second and third casings together, means at the upper ends of said second and third casings adjacent said ground surface sealing said ends of said second and third casings together so as to provide an airtight space between said second and third casings extending from said ground surface to said brine bearing strata above said oil bearing strata, means for introducing fluid under pressure into said airtight space between said second and third casings, and means for continuously monitoring the fluid pressure in said airtight space.

2. The brine leakage monitoring system of claim 1 wherein means is provided for introducing brine into the space between said second casing and said production casing.

3. The brine leakage monitoring system of claim 1 wherein said second and third casings are coaxial and concentric with said first oil production casing.

4. The brine leakage monitoring system of claim 1 wherein said means at the lower and upper ends of said second and third casings for sealing said ends of said second and third casings includes threaded connections.

5. The brine leakage monitoring system of claim 4 wherein said means at the lower and upper ends of said second and third casings for sealing said ends of said second and third casings includes a resilient seal.

6. The brine leakage monitoring system of claim 1 wherein said third casing is encased in cement substantially throughout its entire length.

7. The brine leakage monitoring system of claim 1 wherein the fluid that is introduced under pressure into said airtight space is air.

8. The brine leakage monitoring system of claim 1 wherein said means for continuously monitoring the fluid pressure in the airtight space includes a recording instrument.

9. A continuous brine leakage monitoring system for a production oil well wherein brine is returned to a brine bearing strata in the ground contemporaneously with oil removal from an oil bearing strata, comprising a first oil production casing extending from the surface of the ground to said oil bearing strata, a second casing surrounding and spaced from said first casing, a third casing spaced from and surrounding said second casing, said second and third casings extending from said ground surface to said brine bearing strata, said second and third casings being provided with means at the lower ends of said second and third casings adjacent said brine bearing strata sealing said ends of said second and third casings together, means at the upper ends of said second and third casings together, means at the upper ends of said second and third casings adjacent said ground surface sealing said ends of said second and third casings together so as to provide an airtight space between said second and third casings extending from said ground surface to said brine bearing strata, a vent to the atmosphere located in said space between said second casing and said first oil production casing, means for introducing fluid under pressure into said airtight space between said second and third casings, and means for continuously monitoring the fluid pressure in said airtight space.

* * * * *